US006505406B2

(12) United States Patent
Robertson et al.

(10) Patent No.: US 6,505,406 B2
(45) Date of Patent: Jan. 14, 2003

(54) GUIDE METHOD FOR GUIDING A DEVICE THAT IS DESIGNED TO INSERT ELEMENTS INTO THE GROUND IN ORDER TO MAKE A STRUCTURE, AND A DEVICE FOR INSERTING AT LEAST ONE ELEMENT INTO THE GROUND USING SUCH A GUIDE METHOD

(75) Inventors: Ian Robertson, Andrezy (FR); Jean Ehrsam, Clamart (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/906,067

(22) Filed: Jul. 17, 2001

(65) Prior Publication Data

US 2002/0014015 A1 Feb. 7, 2002

(30) Foreign Application Priority Data

Aug. 1, 2000 (FR) ..... 00 10120

(51) Int. Cl.[7] ..... G01C 15/02

(52) U.S. Cl. ..... 33/1 G; 33/1 CC; 33/1 Q; 33/290

(58) Field of Search ..... 33/1 G, 1 Q, 1 CC, 33/228, 281, 282, 285, 287, 290, 291, 293; 104/2, 10, 11, 12

(56) References Cited

U.S. PATENT DOCUMENTS 3,462,845 A * 8/1969 Matthews ..... 33/290
4,124,299 A * 11/1978 Heystek ..... 33/1 Q
5,313,409 A * 5/1994 Wiklund et al. ..... 33/290
5,331,745 A * 7/1994 Jager ..... 33/287
5,402,226 A * 3/1995 Matthews et al. ..... 33/285
5,983,511 A * 11/1999 Osaragi et al. ..... 33/290
6,243,658 B1 * 6/2001 Raby ..... 33/291
6,317,980 B2 * 11/2001 Buck, III ..... 33/228

FOREIGN PATENT DOCUMENTS

DE 197 55 324 A 6/1999
DE 198 08 812 A 9/1999
FR 2 701 968 A 9/1994

* cited by examiner

*Primary Examiner*—G. Bradley Bennett
(74) *Attorney, Agent, or Firm*—Sughrue Mion, PLLC

(57) ABSTRACT

A guide method for guiding a device that is designed to insert elements into the ground in order to make a structure. The method includes the steps of: establishing topographical points and determining the coordinates of these points in an X, Y, Z frame of reference; putting a measuring station in place in the vicinity of a location where the structure is to be made and determining the X, Y, Z position of the measuring station with reference to one or more topographical points; determining, by means of the measuring station, the distance and the angle between the insertion device and the measuring station; calculating the position of the device by means of the measured distance and the known position of the measuring station; and displacing the insertion device so that the elements are in register on the insertion axis with given positions where the elements are to be inserted into the ground.

11 Claims, 3 Drawing Sheets

GUIDE METHOD FOR GUIDING A DEVICE THAT IS DESIGNED TO INSERT ELEMENTS INTO THE GROUND IN ORDER TO MAKE A STRUCTURE, AND A DEVICE FOR INSERTING AT LEAST ONE ELEMENT INTO THE GROUND USING SUCH A GUIDE METHOD

The invention relates to a guide method for guiding a device that is designed to insert elements into the ground in order to make a structure, and it relates in particular to a guide method for guiding a device of the type described in patent application EP 0 803 609 for inserting baseplates for making a railway track, the device enabling baseplates to be inserted into concrete at given positions that are accurate to within less than 1 millimeter (mm). The invention also relates to a device for inserting elements into the ground that implements such a guide method.

BACKGROUND OF THE INVENTION

A device for inserting baseplates into concrete enabling a railway track to be made quickly and at low cost is known from document EP 0 803 609. However, in order to be effective, such a baseplate insertion device requires the insertion device itself to be put into place accurately so as to obtain an accurate position for each baseplate. At present, the insertion device is used in association with on-site guide rails, previously installed along the path to be followed by the railway track relative to fixed references and as determined by surveying, and serving as a reference for positioning the baseplate insertion device.

However, the prior placement of the on-site guide rails along the path of the railway track presents the drawback of being lengthy and time consuming, and thus of considerably slowing down the construction of the railway track. In addition, in order to obtain good accuracy in positioning the insertion device, it is necessary for the ground supporting the on-site guide rails to be properly stabilized in order to prevent said guide rails from moving under the pressure of the bearing points used by the insertion device to define its position. In addition, the work commonly carried out on such a site is capable of accidentally displacing the guide rails.

OBJECT AND SUMMARY OF THE INVENTION

The object of the present invention is thus to remedy those drawbacks by proposing a guide method enabling an insertion device for inserting elements into the ground to be positioned accurately and quickly, the method being simple to implement and of low cost.

To this end, the invention provides a guide method for guiding a device that is designed to insert elements into the ground in order to make a structure, the method comprising the following steps:

- establishing topographical points and determining the coordinates of these points in an X, Y, Z frame of reference;
- putting a measuring station in place in the vicinity of the structure and determining the X, Y, Z position of the measuring station with reference to one or more topographical points;
- determining, by means of the measuring station, the distance and the angle between the insertion device for inserting elements into the ground and the measuring station;

- calculating the position of the insertion device by means of the measured distance and the measured angle, and the known position of the measuring station; and
- displacing the insertion device so that the elements are in register on the insertion axis with given positions where the elements are to be inserted into the ground.

In particular embodiments, the guide method of the invention can comprise one or more of the following characteristics, taken in isolation, or in any technically feasible combination:

- the measuring station includes an optical-measuring method by means of a laser cooperating with reflectors carried by the insertion device;
- surveys are performed at various reference points distributed along the structure, and as the insertion device advances, the measuring station is displaced over the survey point maximizing the calculation accuracy that can be obtained by means of the measuring station;
- the distance between two successive survey points lies in the range 50 meters (m) to 100 m so as to obtain accuracy to within less than 1 mm in measuring the positions of the elements inserted into the ground;
- displacement of the insertion device is controlled by an on-board controller connected to an on-board computer, as a function of distance and orientation data communicated to the computer at each instant by the measuring station, so as to bring the elements supported by the insertion device substantially into register on the insertion axis with given positions whose coordinates are stored in a memory of the computer;
- the insertion device includes an arm supporting the elements, the arm being driven in translation and in rotation along three axes that are mutually orthogonal, the movement of the arm being controlled by the computer so as to bring the elements accurately into register on the insertion axis with the given positions; and
- the structure is a railway track, and the elements are baseplates designed to support a rail, the baseplates being inserted into a concrete slab before it sets.

The invention also provides an insertion device for inserting at least one element into the ground, the device implementing the above-described guide method, and including at least one reflector designed to reflect an emission from a measuring station and enabling the distance and the angle between the reflector and the measuring station to be determined accurately.

In particular embodiments, the insertion device of the invention for inserting elements into the ground can comprise one or more of the following characteristics, taken in isolation, or in any technically feasible combination:

- the device includes an arm driven in translation and in rotation on three axes that are mutually orthogonal, the arm supporting the elements intended to be inserted into the ground and including reflectors enabling the positions in three dimensions of the arm and of the elements to be inserted into the ground to be known by means of the measuring station;
- the device includes driving and/or steerable wheels or crawler tracks to constitute a vehicle that can move autonomously, the chassis of the vehicle itself being fitted with a reflector;
- the vehicle includes a computer receiving data from the measuring station and calculating the position of the vehicle and of the arm, the computer sending signals to the controller in order to control displacement of the vehicle and of the arm so that the elements are inserted into the ground at predetermined locations; and said elements are baseplates designed to support a railway rail, said baseplates being inserted into a concrete slab before it sets.

BRIEF DESCRIPTION OF THE DRAWINGS

The objects, characteristics, and advantages of the present invention will be better understood on reading the following description of an embodiment of the invention, given as a non-limiting example, and with reference to the accompanying drawings, in which.

MORE DETAILED DESCRIPTION

To make the drawings easier to understand, only those elements that are necessary for understanding the invention are shown.

Figure 1:
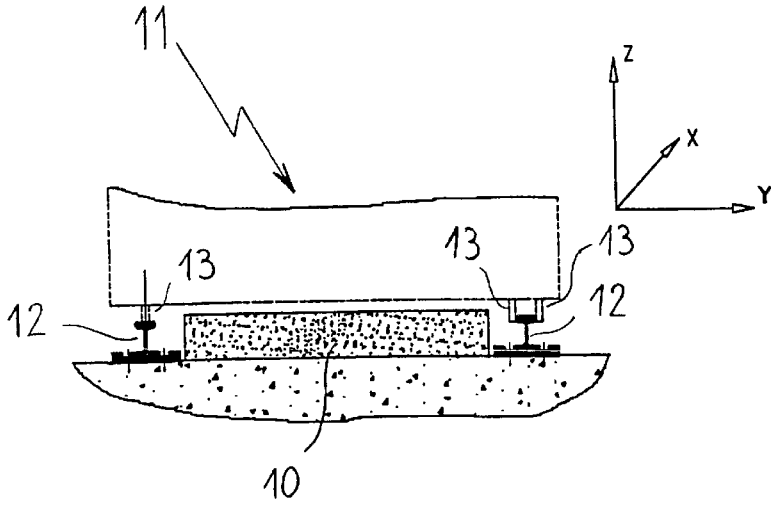
FIG 1 PRIOR ART
FIG. 1 is a diagrammatic section view of an insertion device for inserting baseplates intended to support a railway rail, using a guide method of the prior art.

FIG. 1 shows a vehicle 11 for transporting a baseplate insertion device that is guided into position, in accordance with the prior art, the device being above a track slab 10 before the concrete sets. In FIG. 1, the vehicle 11 for inserting baseplates along the path of the railway track is guided by means of two on-site guide rails 12 disposed on either side of the concrete slab 10 and serving as a reference for positioning the vehicle 11. The baseplate insertion vehicle 11 is fitted with a wheel 13 for holding the vehicle 11 on the rail 12, the wheel bearing against the top face of one of the guide rails 12 and serving as a reference along the insertion axis Z, and with two holding wheels 13 bearing laterally on either side of the second guide rail 12 enabling the vehicle 11 to be referenced in the X, Y plane perpendicular to the insertion axis Z.

Such a guide method has the drawback of requiring the on-site guide rails to be put in place in advance, during a lengthy and meticulous operation, which considerably slows down the speed of progress in constructing the railway track.

Figure 3:
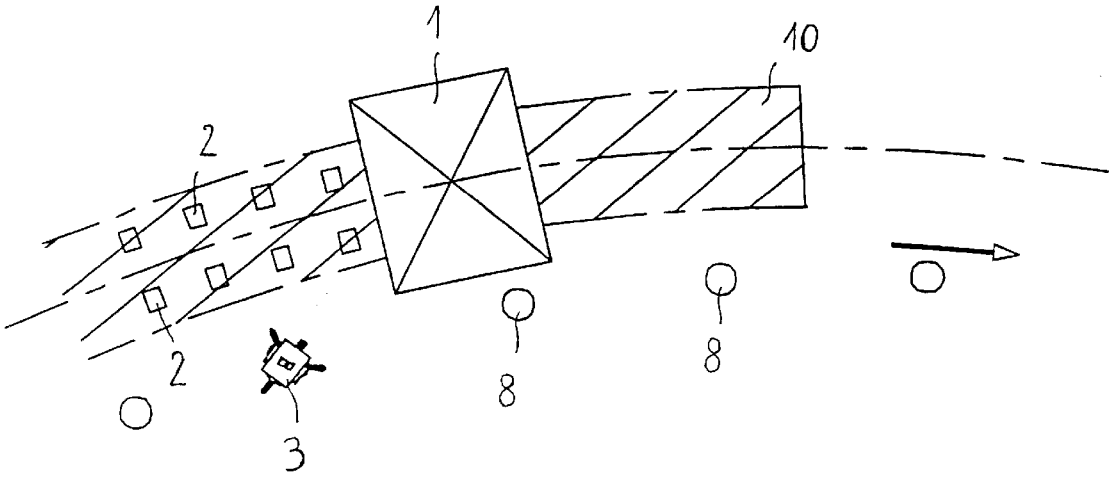
FIG. 3 is a diagrammatic view from above of the baseplate insertion device of FIG. 2 in a bend.
Figure 2:
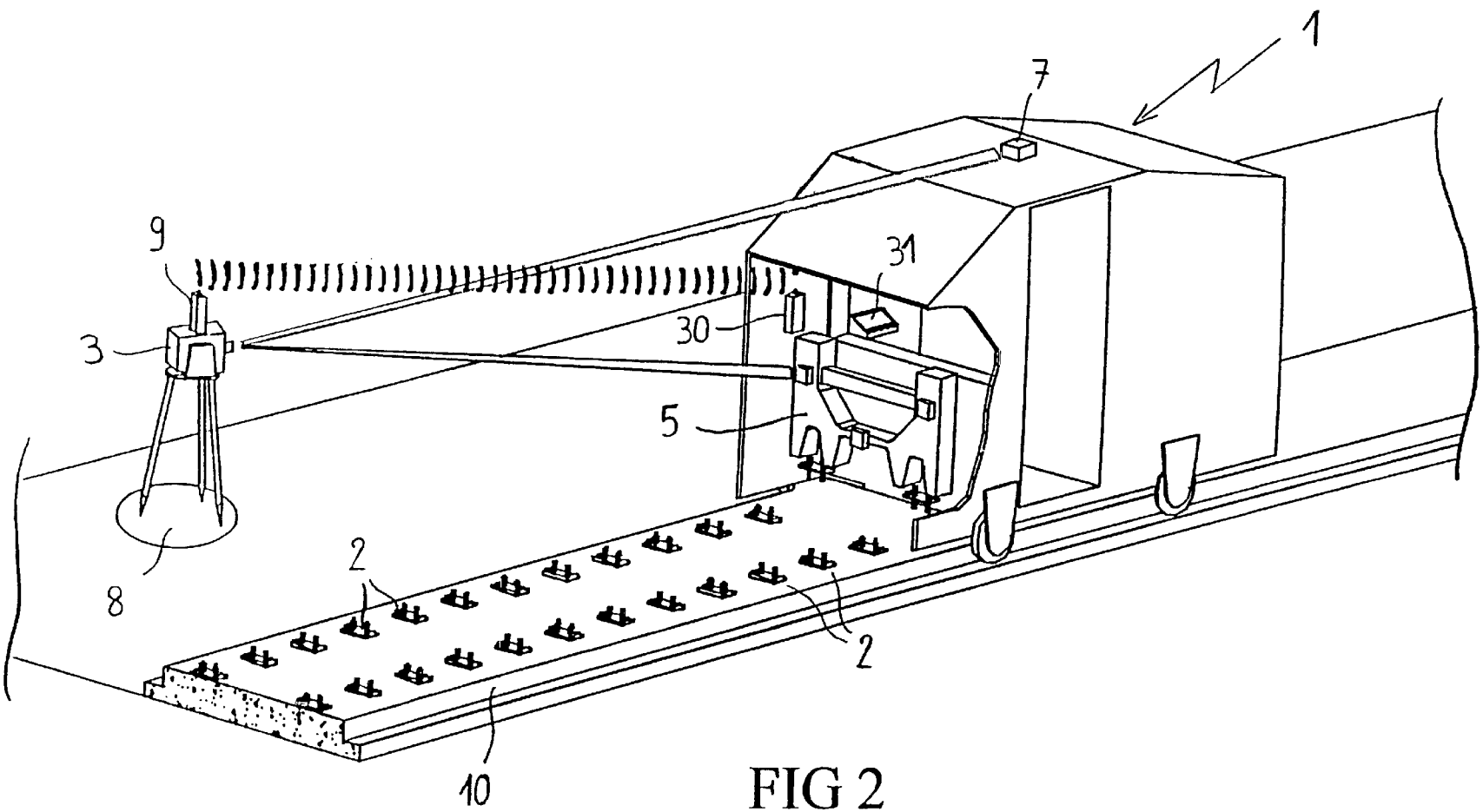
FIG. 2 is a perspective view of an insertion device for inserting baseplates using a guide method of a particular embodiment of the invention.

FIGS. 2 and 3 show an insertion device 1 for inserting baseplates 2, the device being guided along the path of the railway track by a particular implementation of the guide method of the invention.

In FIG. 2, the insertion device for inserting baseplates 2 is constituted by a vehicle 1 mounted on four wheels, of which two are steerable wheels and the other two are driving wheels, enabling the vehicle 1 to move autonomously along a given direction. The vehicle 1 includes a rear face fitted with an arm 5 that is driven in translation and in rotation on the three orthogonal axes X, Y, and Z, and that is provided with a mechanism enabling very accurate displacements.

Figure 4:
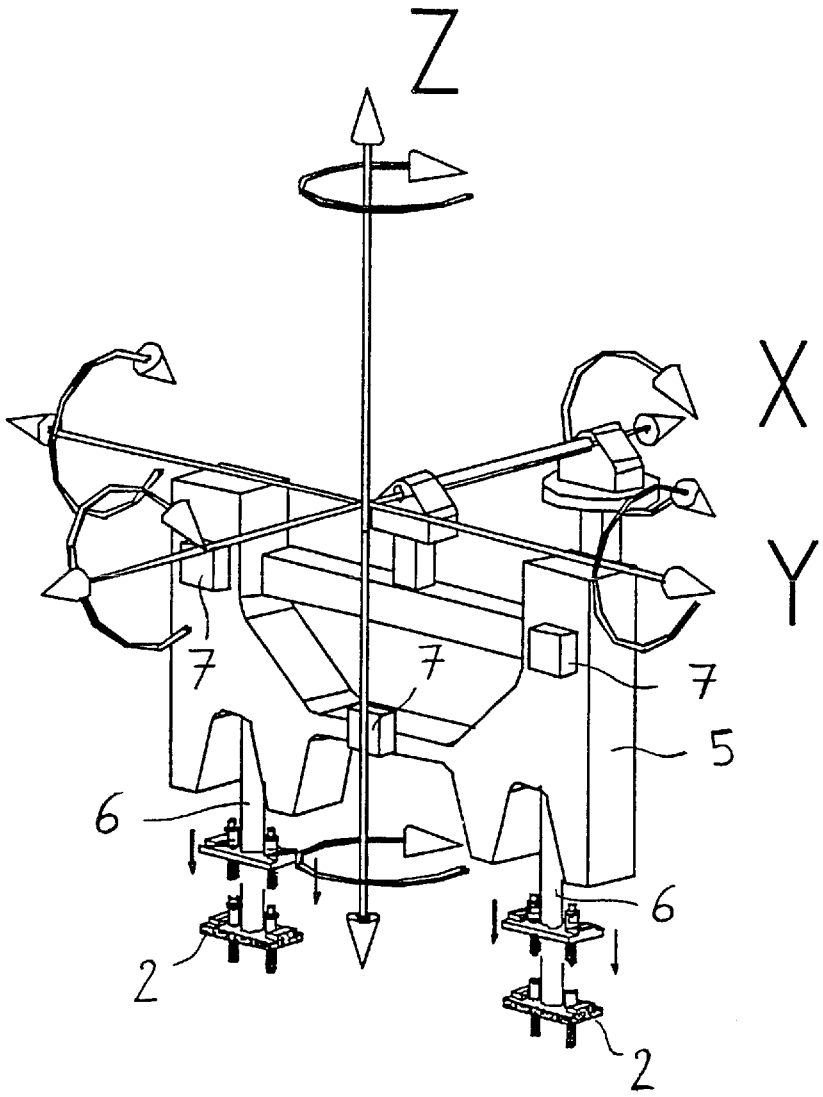
FIG. 4 is view of a detail of the articulated arm of the baseplate insertion device of FIG. 2.

The arm 5, shown on its own in FIG. 4, is generally H-shaped and supports, on its bottom portion, two actuators 6 having respective baseplates 2 for insertion into a freshly cast concrete slab fixed to their ends, the two baseplates 2 being held apart from each other by the arm 5 at a distance that corresponds to the gauge of the track to be installed. The arm 5 is fitted with two angle indicators (not shown) which permanently measure the orientation of the arm 5 relative to the axes X and Y.

Figure 5:
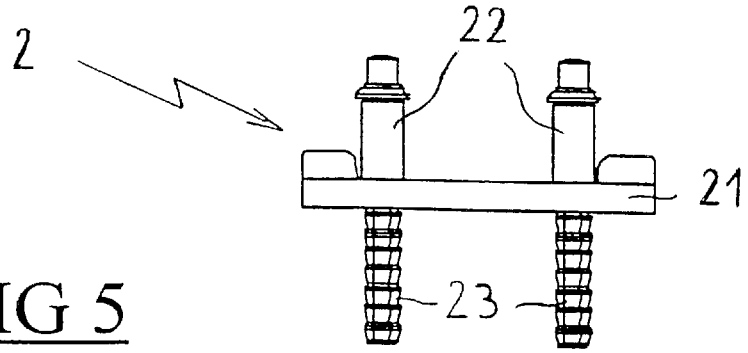
FIG. 5 shows an example of a baseplate that can be used to make a railway track.

The baseplates 2, of which one is shown on its own in FIG. 5, are of conventional type and include a plate 21 made of rigid material, such as cast iron, and two retaining means 22 each comprising a threaded rod enabling a rail to be fixed on the baseplate 2 by means of nuts. The baseplate 2 also includes two foundation bolts 23 of generally cylindrical shape, ensuring that said baseplate is itself retained in the concrete slab 10 when said concrete has set.

In FIG. 4, the arm 5 includes, on its rear face, three reflectors 7 designed to cooperate with a measuring station 3 installed beside the railway track that is to be installed. A reflector 7 is also mounted on the roof of the vehicle 1.

The measuring station 3 disposed beside the path of the railway track is installed on a tripod that is vertically above a survey point 8. The measuring station 3 includes a distance-measuring laser device fitted with a light emitter and a light receiver enabling the distance and the angle between the measuring station and the set of reflectors 7 carried by the arm 5 and the vehicle 1 to be known very accurately. The measuring laser device used is, for example, the device sold by Leica under reference TC/TCA 2003.

The measuring station 3 also includes a radio transmitter 9 that sends the results of measurements taken at each instant by the measuring laser device, to a receiver 30 carried by the vehicle 1. The receiver 30 of the vehicle 1 is connected to a computer 31 that is on-board the vehicle 1, the computer 31 calculating the exact position of the arm 5, in three dimensions (3D), from information sent by the measuring station 3 and from the known position of the survey point 8. The computer 31 is connected to a controller (not shown) which controls the displacement of the arm 5 and of the actuators 6, and also controls the motors enabling the vehicle to be steered and displaced.

The guide method for guiding the baseplate insertion device is described below.

In FIG. 3, prior to the step of inserting the baseplates 2, a plurality of survey points are determined successively along the path of the railway track, at intervals of about 50 m to 100 m, and the points are marked by markers 8.

The day the baseplates 2 are inserted, the insertion vehicle 1 is brought over a portion of track where the concrete slab 10 has been freshly poured and has not yet set. From this starting position of the vehicle 1, the measuring station 3 is advantageously disposed on the nearest survey point 8 having a direct view of the rear face of the vehicle 1, and in particular of the reflectors 7 of the arm 5 and of the vehicle 1. The measuring station 3 is positioned on the point 8 in a very accurate manner by putting the measuring station 3 vertically above the point 8, and the X, Y, Z coordinates of the measuring station 3 are determined by measuring the vertical distance between the measuring station and the point 8 by means of a rod. In another implementation of the method of the invention, the measuring station 3 can alternatively be disposed at any point near to the railway track and having a direct view of the reflectors 7, and the X, Y, Z coordinates of the measuring station 3 are then determined by using the measuring station to view various known survey points and by determining the exact position of the measuring station 3 from the angles and distances measured.

Once the position of the measuring station 3 is known, the distance-measuring laser device is pointed towards the rear face of the vehicle 1 so that it can measure the distance and the angle between itself and each of the reflectors 7 and, in particular, the reflector 7 disposed on the roof of the vehicle 1.

The measurement results are immediately sent, by radio, from the transmitter 9 to the computer 31 disposed on-board the vehicle 1, which computer then calculates the exact 3D position of the vehicle 1 from the data sent by the measuring station 3 and from the known position of the measuring station 3.

Since the exact coordinates of the points where the baseplates 2 are to be inserted have previously been stored in a memory of the computer 31, the computer 31 calculates, from said points and from the position of the vehicle 1 measured by the station, the distance between the arm 5 and the position where the next baseplates 2 is to be inserted, the arm then being in a rest position from which it can move over several centimeters (cm) and with six degrees of freedom. From this distance, the computer 31 sends signals to the controller which controls the driving and steerable wheels so as to displace the vehicle 1 along the axis of the track until the articulated arm 5, that remains stationary in its rest position, has. been brought substantially up to the points where the baseplates 2 are theoretically to be inserted. Naturally, in view of the slack existing in the transmission of the vehicle 1, the positioning of the vehicle relative to the track is thus not very accurate, i.e. it is accurate to within about 1 cm.

Once the vehicle 1 stops in said position, the computer 31 verifies the 3D position of the arm 5 from the data transmitted by the measuring station 3 and sends signals to the controller so as to control the movement of the articulated arm 5 on six axes of freedom so as to bring the baseplates 2 carried by the arm 5 into register with the ideal insertion points for the baseplates 2, and to do so with very good accuracy. The actuators 6 are then actuated to insert the baseplates 2 into the soft concrete 10 following a method described in patent application EP 0 803 609.

Once the two baseplates 2 are inserted, the arm 5 is returned to its rest position and the computer 31 searches the coordinates of the following points where the new baseplates 2 are to be inserted. The guide method for bringing the vehicle 1 into register with said new points is similar to that described above.

In order to maintain sufficient accuracy in guiding the baseplate insertion vehicle 1, so as to obtain accuracy to within less than 1 mm in the positioning of the baseplates, the measuring station 3 is regularly changed to the survey point 8 which is nearest to the vehicle 1, and which has a direct view of the set of reflectors 7.

Such a guide method has the advantage of being operational very quickly and of being of low cost to implement, requiring only the installation of survey points every 50 m to 100 m and the installation of the measuring station on the day the baseplates are to be inserted. In addition, such a guide method has the advantage of not using direct contact between the baseplate insertion device and the frame of reference used, thus eliminating the physical stresses that can be generated by the baseplate insertion device on the frame of reference.

Naturally, the invention is not limited to the embodiment described and shown, which is given only by way of example.

The example thus describes an insertion device for inserting baseplates into a concrete slab, but the guide method of the invention can equally well be used for guiding an insertion device for inserting any element necessary for making a structure.

In variant embodiments not shown, the insertion device could be fitted with crawler tracks instead of wheels or with any other means enabling the insertion device to be displaced.

What is claimed is:

1. A guide method for guiding a device that is designed to insert elements into the ground in order to make a structure, the method comprising the following steps:

establishing topographical points and determining the coordinates of these points in an X, Y, Z frame of reference;

putting a measuring station in place in the vicinity of a location where the structure is to be made and determining the X, Y, Z position of said measuring station with reference to one or more topographical points;

determining, by means of said measuring station, the distance and the angle between said insertion device and the measuring station;

calculating the position of the device by means of the measured distance and the known position of the measuring station; and displacing the insertion device so that said elements are in register on the insertion axis with given positions where the elements are to be inserted into the ground.

2. A guide method according to claim 1 for guiding an insertion device, wherein said measuring station includes an optical-measuring method by means of a laser cooperating with reflectors carried by the insertion device of the elements.

3. A guide method according to claim 1 for guiding an insertion device, wherein surveys are performed at various reference points distributed along the structure, and wherein, as the insertion device advances, the measuring station is displaced over the survey point maximizing the calculation accuracy that can be obtained by means of the measuring station.

4. A guide method according to claim 3 for guiding an insertion device, wherein the distance between two successive survey points lies in the range 50 meters (m) to 100 m so as to obtain accuracy to within less than 1 mm in measuring the positions of the elements.

5. A guide method according to claim 1 for guiding an insertion device, wherein displacement of the insertion device is controlled by an on-board controller connected to an on-board computer, as a function of distance and orientation data communicated to the computer at each instant by the measuring station, so as to bring said elements supported by the insertion device substantially into register on the insertion axis with given positions whose coordinates are stored in a memory of the computer.

6. A guide method according to claim 1 for guiding an insertion device, wherein said insertion device includes an arm supporting said elements, said arm being driven in translation and in rotation along three axes that are mutually orthogonal, the movement of said arm being controlled by the computer so as to bring the elements accurately into register on the insertion axis with the given positions.

7. A guide method according to claim 1 for guiding an insertion device, wherein said structure is a railway track, and wherein said elements are baseplates designed to support a rail, said baseplates being inserted into a concrete slab before it sets.

8. An insertion device for inserting at least one element into the ground, the device implementing a guide method according to claim 1, and including an arm driven in translation and in rotation on three axes that are mutually orthogonal, said arm supporting the elements intended to be inserted into the ground and including reflectors enabling the positions in three dimensions of said arm and of said elements to be known by means of a measuring station.

9. An insertion device according to claim 8, including at least one of wheels and crawler tracks to constitute a vehicle that can move autonomously, the chassis of said vehicle itself being fitted with a reflector.

10. An insertion device according to claim 8, including at least one of wheels and crawler tracks to constitute a vehicle that can move autonomously, the chassis of said vehicle itself being fitted with a reflector, and further including a computer receiving data from the measuring station and calculating the position of the vehicle and of said arm, said computer sending signals to the controller in order to control displacement of said vehicle and of the arm so that said elements are inserted into the ground at predetermined locations.

11. An insertion device according to claim 8, wherein said elements are baseplates designed to support a rail, said baseplates being inserted into a concrete slab before it sets.

* * * * *